US009652974B1

(12) United States Patent
Roberts

(10) Patent No.: US 9,652,974 B1
(45) Date of Patent: May 16, 2017

(54) HEURISTIC ELECTRONIC MONITORING SECURITY DEVICE ASSOCIATION

(71) Applicant: SureView Systems, LLC, Tampa, FL (US)

(72) Inventor: Paul Roberts, St. Petersburg, FL (US)

(73) Assignee: Sureview Systems, LLC, Tampa, FL (US)

( * ) Notice: Subject to any disclaimer, the term of this patent is extended or adjusted under 35 U.S.C. 154(b) by 0 days.

(21) Appl. No.: 14/976,993

(22) Filed: Dec. 21, 2015

Related U.S. Application Data

(60) Provisional application No. 62/094,611, filed on Dec. 19, 2014.

(51) Int. Cl.
*G08B 29/00* (2006.01)
*G08B 29/02* (2006.01)

(52) U.S. Cl.
CPC ..... *G08B 29/02* (2013.01)

(58) Field of Classification Search
CPC ..... G08B 29/02
See application file for complete search history.

(56) References Cited

U.S. PATENT DOCUMENTS 8,836,467 B1 * 9/2014 Cohn ..... G08B 25/003 340/3.32
2006/0154642 A1 * 7/2006 Scannell, Jr. ..... A01G 9/02 455/404.1
2010/0299517 A1 * 11/2010 Jukic ..... H04L 63/0823 713/150
2015/0160634 A1 * 6/2015 Smith ..... G05B 11/01 700/90
2015/0363563 A1 * 12/2015 Hallwachs ..... G06F 19/3406 705/3

* cited by examiner

*Primary Examiner* — Erin File
(74) *Attorney, Agent, or Firm* — Nicholas Pfeifer; Smith & Hopen, P.A.

(57) ABSTRACT

The present invention includes a security-monitoring platform adapted to automatically create associations between electronic monitoring security devices and security alerts on the fly. As alerts occur, the security-monitoring platform operator may select one or more electronic monitoring security devices to aid in processing the security alert, and the security-monitoring platform automatically identifies the selected electronic monitoring security device(s) and creates an association between the selected electronic monitoring security device(s) and the security alert. The security-monitoring platform will then automatically display the associated electronic monitoring security device to the operator when that same security alert is subsequently triggered.

12 Claims, 5 Drawing Sheets

HEURISTIC ELECTRONIC MONITORING SECURITY DEVICE ASSOCIATION

CROSS-REFERENCE TO RELATED APPLICATIONS

This nonprovisional application is a continuation of and claims priority to provisional application No. 62/094,611, entitled "Heuristic Security Event Association," filed Dec. 19, 2014 by the same inventor.

BACKGROUND OF THE INVENTION

1. Field of the Invention

This invention relates, generally, to the association of electronic monitoring security devices to specific alerts in a security-monitoring platform. More specifically, it relates to a security-monitoring platform having the ability to associate a particular electronic monitoring security device to another electronic monitoring security device and/or a specific alert on the fly and learn that association for future automated camera display.

2. Brief Description of the Prior Art

Securing an asset or facility often requires more than single security system. Ideally, there should exist several security systems all monitored and controlled by a single security-monitoring platform (SMP). Security systems include, but are not limited to, video systems to provide a view of what is happening at the location, door access control systems to control who can access the location or areas within, intrusion detection systems to detect intruders (for example motion detection sensors detecting body heat), audio systems to provide one-way or two-way audio communications, lone worker GPS-enabled devices with a panic button for guards, and situational awareness systems to provide information outside of traditional alarm sources such as earthquake and weather warnings.

SMPs are often employed to help monitor and control the various electronic monitoring security devices provided by the security systems. An electronic monitoring security device includes, but is not limited to any alarm source, video source, output, or audio source connected to any security system.

The SMP is designed to integrate several security systems into a single platform. As shown in FIG. 1, security system 101, and in turn its electronic monitoring security devices 102-105, are in communication with SMP 107 using manufacturer's application programming interface (API) 106. Once connected, the SMP operator is capable of interacting with the particular electronic monitoring security devices 102-105 provided by each system 101 (i.e. receive alarms from the alarm devices 103, view live video from camera devices 102, control the outputs of output devices 104, and transmit/receive audio from audio devices 105). FIG. 1 provides a simplified illustration of SMP 107 communicating with only a single security system 101, however, SMPs are intended to operate with several security systems to provide a fully integrated platform.

The electronic monitoring security devices are preferably strategically arranged with respect to one another to provide the SMP operator with optimal situational awareness. For example, FIG. 2 provides a simplistic illustration of room 201's security measures where every alarm source 202, 204 is caught in the view frame of a camera 203, 205, respectively. As a result, an SMP operator can fetch a specific camera feed to view the source of an alarm-triggering alert.

When working with a limited number of electronic monitoring security devices, a system operator may easily memorize which devices provide situational awareness for each alert, such as which camera provides a view of a particular alarm source. In contrast, when the system operator is responsible for hundreds or even thousands of alarm sources and cameras, it is nearly impossible for an operator to memorize even just the cameras associated with each alarm source. The current state of the art, as shown in FIG. 3, addresses this issue by requiring operator 307 to manually create relationships between each camera 304, 306 and each alarm source 303, 305 in the data store 302 prior to launching SMP 301.

The problem with the current art is that the associations between one or more electronic monitoring security device and/or alerts (i.e. cameras and alarm sources) must be manually inputted before fully implementing the security system and monitoring platform. As previously noted, some security systems include hundreds or even thousands of electronic monitoring security devices, resulting in an extensive amount of time and money to properly associate each security alert with one or more electronic monitoring security devices prior to operation. In addition, any updates to the electronic monitoring security devices in operation or inclusions of additional electronic monitoring security devices requires a manual association update, which may necessitate an operator to visit the site to determine the correct associations.

Accordingly, what is needed is a system and method to reduce the time and effort needed to create and maintain an association between each electronic monitoring security device association and another electronic monitoring security device and/or a security alert. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a system and method to reduce the time and effort needed to create and maintain an association between an electronic monitoring security device and another electronic monitoring security and/or a security alert is now met by a new, useful, and nonobvious invention.

The novel invention includes a method and system for automatically creating association between security alerts and one or more electronic monitoring security devices on the fly as alerts occur. The present invention includes an association module in electronic communication with a security system and a security-monitoring platform (SMP). The SMP encapsulates an application programming interface for one or more security systems intended to operate in conjunction with the SMP and stores access information for each security system in a data store that is electronically linked to the SMP. In an embodiment, the SMP retrieves a list of possible security alerts producible by each electronic monitoring security device and stores the list in the SMP data store. In an embodiment, the electronic monitoring security devices are categorized into types of electronic monitoring security devices. For example, the categories may include cameras, alarms, door readers, outputs, window readers, etc.

In an embodiment, the SMP presents the operator with a security alert list on the SMP operator interface. The association module monitors the security alert list and identifies any operator selected security alerts. In an embodiment, the alert may be automatically chosen for the operator based on a predetermined priority. Once an alert is selected or presented to the operator, the association module automatically initiates the association protocol.

In an embodiment, the security alert list may include electronic monitoring security devices instead of specific alerts from the electronic monitoring security devices or may include both electronic monitoring security devices and specific alerts from electronic monitoring security devices.

The association protocol includes several steps in automatically associating of one or more electronic monitoring security devices with a security alert. The association module first identifies the security alert selected by or presented to the operator. Then the association module automatically accesses the data store to determine whether any electronic monitoring security devices are digitally associated with the selected security alert.

If a digital association exists between the selected security alert and any of the electronic monitoring security devices, the association module automatically presents the associated electronic monitoring security device(s) to the operator on the SMP operator interface.

In an embodiment, regardless of whether a digital association currently exists between the security alert and one of the electronic monitoring security devices, a list of electronic monitoring security devices is displayed to the operator on the SMP operator interface. In an embodiment, the list might only be displayed when an association does not exist between the security alert and electronic monitoring security devices.

In an embodiment that categorizes the electronic monitoring security devices into separate lists, each categorized list of electronic monitoring security devices is presented to the operator. In a certain embodiment, only the categories of electronic monitoring security devices that do not already include an association of an electronic monitoring security device with the current security alert are presented to the operator.

After the list(s) of electronic monitoring security devices is presented to the operator, the association module monitors the list(s) to determine whether the operator selects one of the electronic monitoring security devices from the list(s) of electronic monitoring security devices. Each time an operator selects an electronic monitoring security device from the list of electronic monitoring security devices, the selected electronic monitoring security device is displayed to the operator on the SMP operator interface. In an embodiment, the association module automatically creates a digital association between the selected electronic monitoring security device and the selected security alert each time that an electronic monitoring security device is selected.

In an embodiment, the association module automatically creates a digital association between the selected electronic monitoring security device and the selected security alert when the operator performs an end processing action. In an embodiment, the digital association is between the selected security alert and the electronic monitoring security device that was last selected before the operator performed the end processing action.

In an embodiment, a digital association is automatically created between the selected security alert and the selected electronic monitoring security device for each of the plurality of categories of electronic monitoring security devices.

In an embodiment, cross-associations are automatically created between each of the electronic monitoring security devices that are associated with a single selected security alert.

In an embodiment, any previous associations between the selected security alert and an electronic monitoring security device are removed when an association is created between the selected security alert and another electronic monitoring security device.

In an embodiment, the SMP operator interface may display several electronic monitoring security devices simultaneously and digital associations may be created between the selected security alert and each of the selected electronic monitoring security device displayed on the SMP operator interface when the end processing action is performed.

Once an association is created, it is stored in the SMP data store. When the security alert is subsequently triggered, every associated electronic monitoring security device is automatically displayed to the operator on the SMP operator interface These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
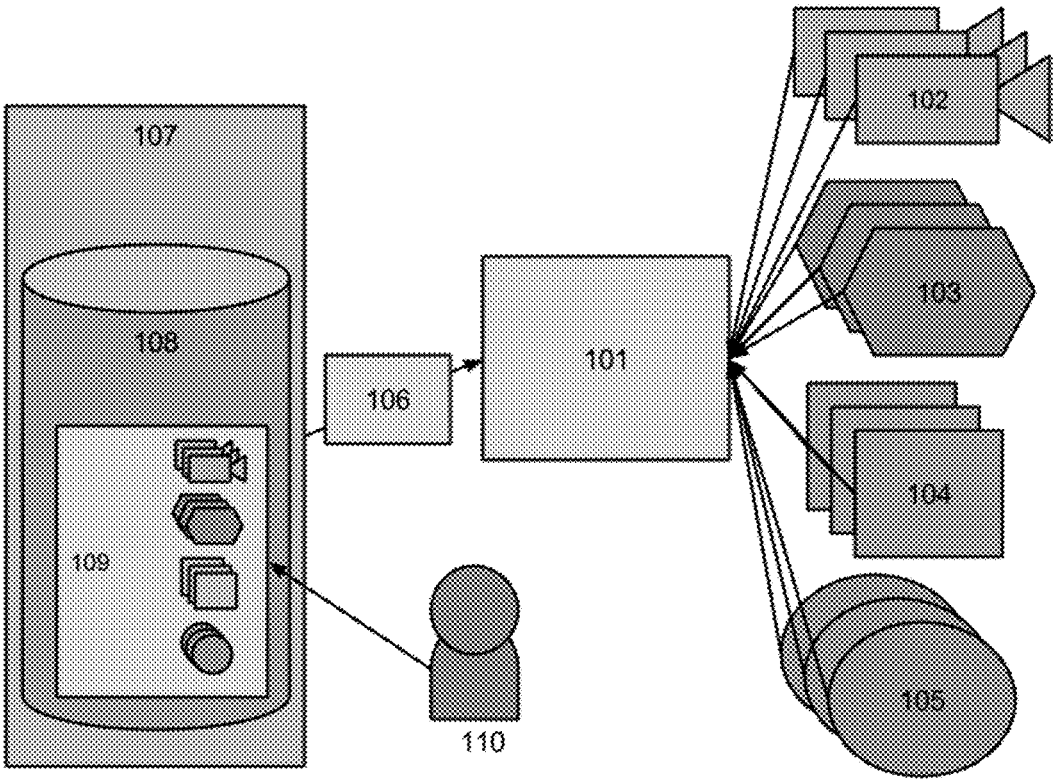
(Prior Art) FIG. 1
FIG. 1 is a schematic diagram illustrating the typical communication structure of a security-monitoring platform and a security system.
Figure 2:
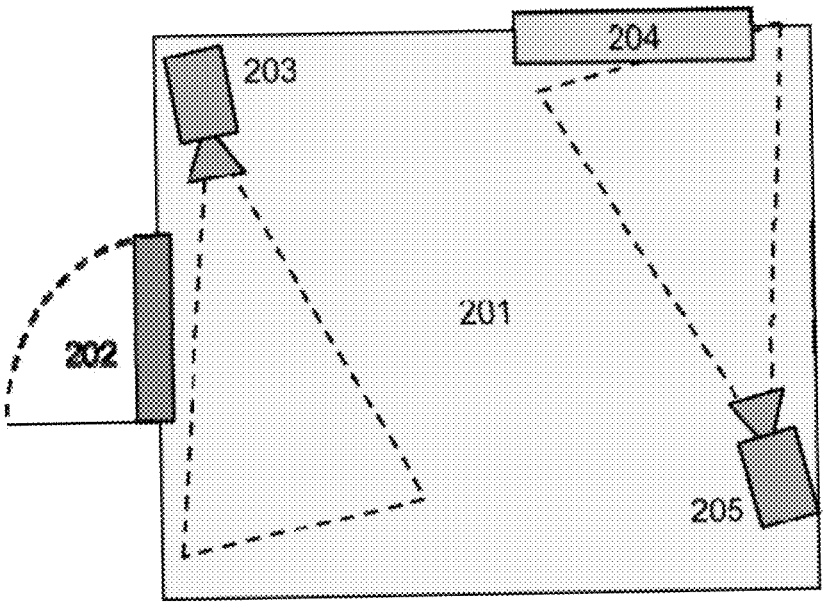
FIG. 2 is an exemplary illustration of a room being monitored by security systems.
Figure 3:
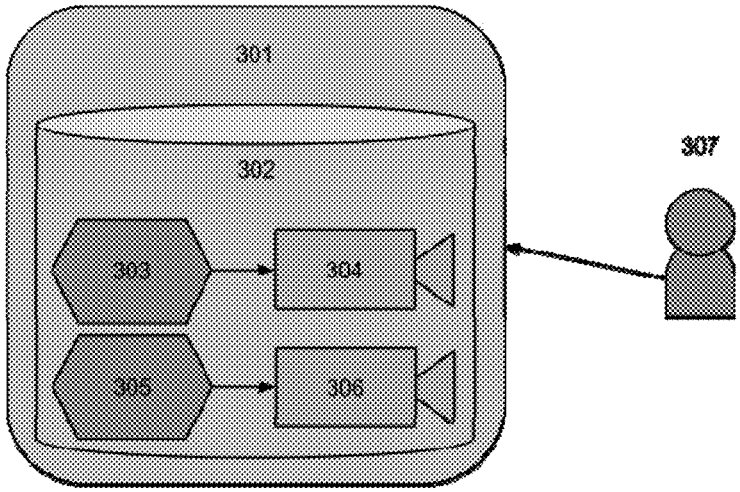
(Prior Art) FIG. 3
FIG. 3 is a block diagram providing an example of the prior art.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention includes a security-monitoring platform (SMP) adapted to automatically create and store associations between two or more electronic monitoring security devices and/or alerts on the fly as alerts occur. An alert is any action or occurrence that is identifiable by a security system, not just threats or alarms. For example, access control systems monitor and control nearly every aspect of a door. Therefore, a non-threatening alert could include, inter alia, a valid card swipe, while a threatening alert could include, inter alia, a forceful entry. Non-threatening alerts are monitored because an operator may want to keep a record of non-threatening activities, such as visual records confirming the identity of persons executing a valid card swipe.

The SMP is a system adapted to monitor and preferably control all of the security systems in use. For example, if a building has an access control system (system using swipe cards for door locks) made by one manufacturer and a camera system made by a second manufacturer, the SMP integrates both of the systems and enables an operator to utilize the cameras and access control system as a single system. This is usually not possible without the SMP because security systems that originate from different manufactures are typically incapable of communicating with one another.

Each security system is self-contained and includes a system-specific application programming interface (API). The API for each security system is unique to that security system, but each API provides the necessary communicability to enable a user to control and utilize the security system. For example, an API can provide (1) a connection to web services inside the security system allowing a user to execute commands to query and control the security system's electronic monitoring security devices, (2) a connection to the data store of the security system, and/or (3) a proprietary connection through a software development kit (SDK) with functions allowing a user to query and control the security system's electronic monitoring security devices.

The SMP automatically encapsulates each security system's API to provide the SMP operator with a uniform format for operating each security system. The encapsulation of each security system's API allows the SMP operator to control the security system's electronic monitoring security devices and perform functions, such as:

1) Connect (connect to the security system)
2) Receive Alerts (start receiving alerts from the security system, which are then presented to operators and associated by the invention)
3) Get Cameras (get all the cameras on the security system)
   i) Get Cameras On Site/Device/Group 'X' (get all the cameras on a particular site, device, or 'grouping' within the security system)
4) Get Alert Sources (get the list of alert sources that exist on the system)
   i) Get Alert Sources On Site/Device/Group 'X' (get all the alerts sources on a particular site, device, or 'grouping' within the security system)
5) Get Outputs (get all outputs on the system)
   i) Get Outputs On Site/Device/Group 'X' (get all the outputs on a particular site, device, or 'grouping' within the security system)
6) Get Audio Inputs and Outputs
   i) Get Audio Inputs and Outputs on Site/Device/Group 'X' (get all the audio inputs/output on a particular site, device, or 'grouping' within the security system)

Furthermore, the encapsulation of the each security system's API enables the SMP operator to monitor each security system simultaneously. Once the SMP establishes a digital connection between the security system and the SMP, the connection details are stored on the SMP. The SMP also records the operational information for each electronic monitoring security device in each security system enabling the SMP to identify and distinguish each electronic monitoring security device from another.

An electronic monitoring security device may be capable of generating several types of alerts. The operational information retrieved from the security systems includes the possible alerts for each electronic monitoring security device. For example, an access control system can generate, inter alia, "access denied" or "door forced," an alarm system can generate, inter alia, "zone activated," and a video management system can generate, inter alia, "motion detection" or "person seen."

When an alert occurs, the security system receives information identifying the electronic monitoring device that raised the alert. For example, the information received by the security system may include the door number, zone number, or camera number. The SMP digitizes this information and reformats it to correspond to the operational information previously captured. As a result, the SMP is capable of identifying the specific electronic monitoring security device that raised the alert. In an embodiment, the SMP may identify a specific alert from an electronic monitoring security device rather than just the electronic monitoring security device.

Figure 4:
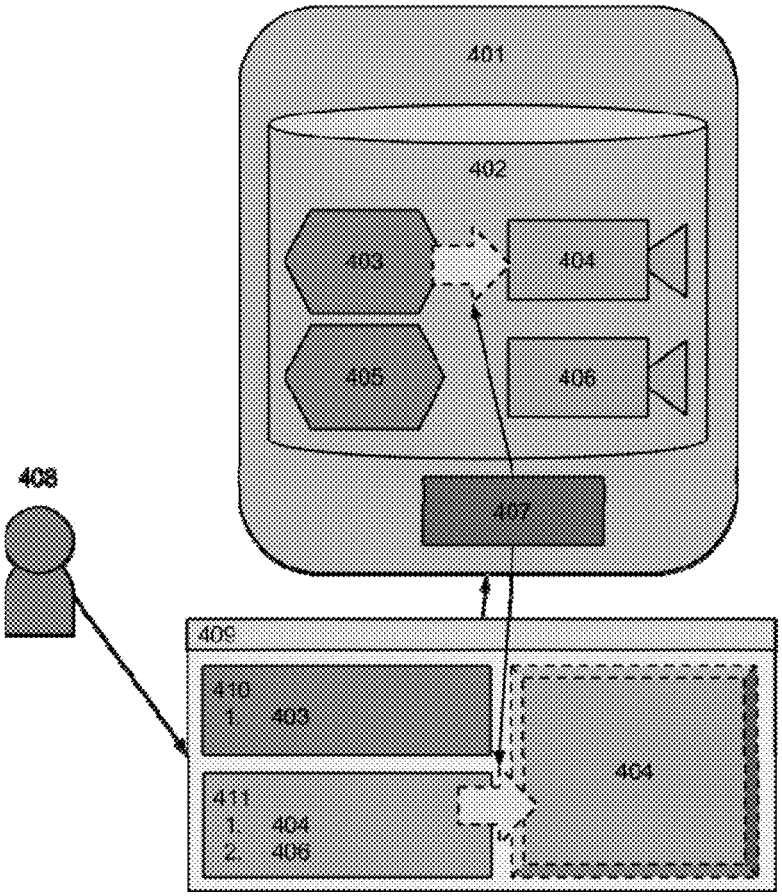
FIG. 4 is a block diagram of a certain embodiment of the present invention.

Referring now to the exemplary illustration in FIG. 4, SMP 401 includes data store 402, storing the operational information and the encapsulated APIs associated with each alarm source 403, 405 and each camera 404, 406. SMP 401 also includes association module 407 and SMP operator interface 409 to enable operator 408 to interact and control the SMP and security systems. When an alert arises, SMP operator interface 409 notifies operator 408 of the alert in alert list 410.

Association module 407 monitors a user's selection of an alert from alert list 411. When an alert is chosen for processing, for example 403 in FIG. 4, the association module initiates the association protocol. In accordance with the association protocol, the association module identifies the chosen alert 403 and accesses SMP data store 402 to determine whether any cameras 404 and 406 are associated with the chosen alert 403. In addition, the association module 407 monitors operator 408's selection from camera list 411. If operator 408 selects a camera from camera list 411, such as 404 in the present example, association module 411 automatically stores an association between alert 403 and camera 404 in data store 402. When the same alert 403 is selected for processing at a later date or time, SMP 401 automatically displays camera 404 to operator 408 on SMP operator interface 409.

While the exemplary illustration in FIG. 4 is limited to alarm sources and cameras, an embodiment of the present invention is operational with any electronic monitoring security device. In addition, an embodiment may display to the user an alert list having both alerts and electronic monitoring security devices. For example, at a base level the association could exist between an alert producing device and one or more other electronic monitoring security devices, such that anytime the alert producing device produces an alert, the associated electronic monitoring security devices are automatically loaded for the operator. At a more advanced level, the associations could be created between specific alerts from an electronic monitoring security device and any other electronic monitoring security devices. In turn, the present invention may create associations between two or more electronic monitoring security devices and also between a specific alert and one or more electronic monitoring security devices.

In an embodiment, SMP 401 classifies the electronic monitoring security devices into a plurality of specific categories of electronic monitoring security devices and displays a list for each category of electronic monitoring security devices on SMP interface 409. In such an embodiment, associations may be created between the selected alert and an electronic monitoring security device from each category of electronic monitoring security devices. Moreover, the SMP operator interface may display each previously associated electronic monitoring device simultaneously when an alert occurs.

Figure 5:
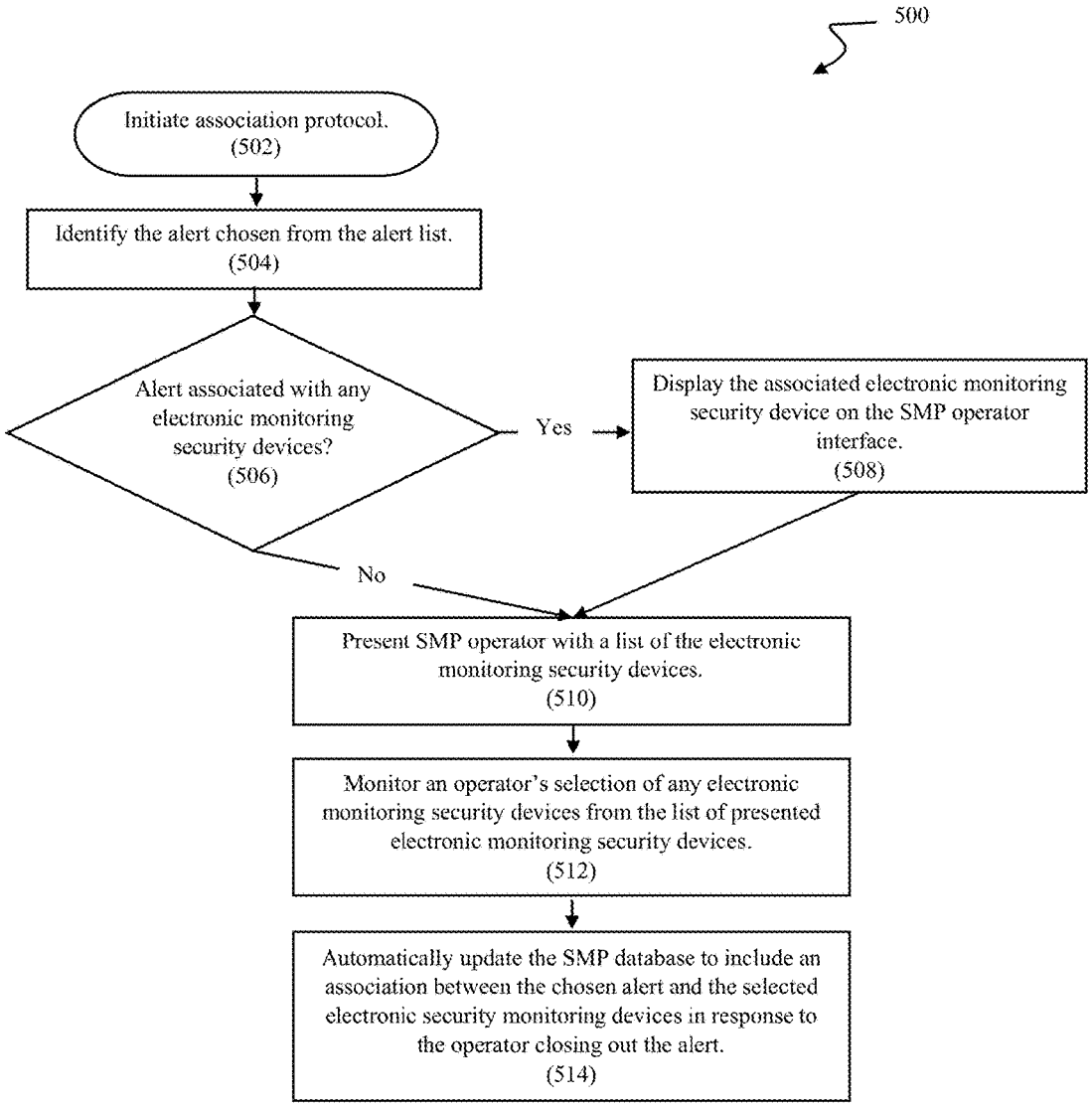
FIG. 5 is a flowchart of a certain embodiment of the present invention.

Referring now to FIG. 5, an embodiment of the association protocol is generally referred to as reference numeral 500. Association protocol 500 is initiated at step 502 and the association module identifies an alert or electronic monitoring security device (hereinafter referred to collectively as the selected alert) selected for processing at step 504. At step 506, the association module accesses the SMP data store to determine whether any electronic monitoring security devices are associated with the selected alert. Any electronic monitoring security devices that are found to be associated with the selected alert are automatically displayed to the operator on the SMP operator interface at step 508.

After the associated electronic monitoring security devices are displayed to the operator or if no electronic monitoring security devices are associated with the selected alert, the SMP operator is presented with a list of available electronic monitoring security devices (i.e. list 411 in FIG. 4) at step 510. In an embodiment, the electronic monitoring security devices are classified into categories with a list for each category being displayed at step 510. Furthermore, an embodiment, may remove any electronic monitoring security devices, currently associated with the selected alert, from the displayed lists.

At step 512, the association module monitors the SMP operator's actions to determine whether the SMP operator selects any electronic monitoring security devices from the list of available electronic monitoring security devices displayed on SMP interface. At step 514, the association module automatically creates an association between the chosen alert and last selected electronic monitoring security device accessed in response to the operator completing or ending the processing of the chosen alert. The completion or end of the processing of an alert can be any action taken by the operator that stops the processing of the current alert. For example, an action considered to stop the current processing (hereinafter referred to as an "'end processing action"), includes but is not limited to, closing the alert, removing the alert from the alert list, removing the alert from the SMP interface, and opening a different alert for viewing on the SMP interface.

In an embodiment including several categories of electronic monitoring security devices, the association module stores the last selected electronic monitoring security device for each category of electronic monitoring security devices. In an embodiment, the association module may store associations in response to each selection from an electronic monitoring security device list rather than waiting for an end processing action.

If the electronic monitoring security devices are not categorized by types of electronic monitoring security devices, the association module may delete any previous existing association.

In an embodiment, the SMP automatically presents the operator with an alert rather than waiting for an operator to select an alert from the alert list. In this particular embodiment, the association protocol is initiated when an alert is presented to the operator or when an alert is displayed on the SMP operator interface.

In an embodiment, the SMP may withhold the display of an electronic monitoring security device list when the association protocol determines that the current alert is already associated with an electronic monitoring security device. In an embodiment having categories of electronic monitoring security devices, the SMP may withhold the display of a categorized electronic monitoring security device list when the association protocol determines that the current alert is already associated with an electronic monitoring security device that is stored in that categorized electronic monitoring security device list.

In a certain embodiment, the operator may select and simultaneously view multiple electronic monitoring security devices for a single alert and the association module will create multiple associations.

In an embodiment, the association module identifies each association based on the type of electronic monitoring security device and automatically stores the associations for each type of electronic monitoring security device.

In an embodiment, the association module automatically creates cross-associations between each type of electronic monitoring security device chosen by the SMP operator when addressing an alert. As a result, an alert arising from any of the cross-associated electronic monitoring security devices will automatically display the other electronic monitoring security devices that are cross-associated with the electronic monitoring security device that produced the alert.

Hardware and Software Infrastructure Examples

The present invention may be embodied on various computing platforms that perform actions responsive to software-based instructions and most particularly on touch-screen portable devices. The following provides an antecedent basis for the information technology that may be utilized to enable the invention.

The computer readable medium described in the claims below may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any non-transitory, tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wire-line, optical fiber cable, radio frequency, etc., or any suitable combination of the foregoing. Computer program code for carrying out operations for aspects of the present invention may be written in any combination of one or more programming languages, including an object oriented programming language such as Java, C#, C++, Visual Basic or the like and conventional procedural programming languages, such as the "C" programming language or similar programming languages.

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

It should be noted that when referenced, an "end-user" is an operator of the software as opposed to a developer or author who modifies the underlying source code of the software. For security purposes, authentication means identifying the particular user while authorization defines what procedures and functions that user is permitted to execute.

GLOSSARY OF CLAIM TERMS

Application Programming Interface: is a software intermediary enabling application programs to interact with each other and share data.

Association: is a software-based link.

Data Store: is any hardware or software capable of storing information.

Electronic Monitoring Security Device: is any monitoring device operating as part of a security system, including, but not limited to, alarm source, video source, output, or audio source.

Encapsulate: is an action to alter a particular computer code to operate in conjunction with another system or program.

End Processing Action: is an action that stops the current processing of an alert.

Operational Information: is descriptive information of the electronic monitoring security device, such as the name of the electronic monitoring security device, and its connection information with respect to the security system.

Security Alert: is any event identifiable by a security system.

Security System: is any system providing security measures.

Security-Monitoring Platform: is a system in communication with one or more security systems designed to allow an operator to monitor and sometimes control the security system and its electronic monitoring security devices.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A computer-implemented method for automatically associating electronic monitoring security devices with a security alert comprising executing on a processor the steps of:

encapsulating an application programming interface for one or more security systems intended to operate in conjunction with a security-monitoring platform;

storing access information for the one or more security systems in a data store that is electronically linked to the security-monitoring platform;

automatically initiating an association protocol, wherein the association protocol includes the steps of:

monitoring a security-monitoring platform operator interface and identifying a security alert selected by an operator from a security alert list presented to the operator on the security-monitoring platform operator interface;

accessing the data store to determine whether any electronic monitoring security devices are digitally associated with the selected security alert;

responsive to identifying a digital association between the selected security alert and any of the electronic monitoring security devices, automatically presenting the associated electronic monitoring security device to the operator on the security-monitoring platform operator interface;

displaying a list of electronic monitoring security devices to the operator on the security-monitoring platform operator interface;

monitoring the list of electronic monitoring security devices to determine whether the operator selects one of the electronic monitoring security devices from the list of electronic monitoring security devices;

for each selection of one of the electronic monitoring security devices from the list of electronic monitoring security devices, displaying the selected electronic monitoring security device to the operator on the security-monitoring platform operator interface; and responsive to the operator performing an end processing action of the selected security alert, creating a digital association between the selected security alert and the selected electronic monitoring security device.

2. The computer-implemented method of claim 1, wherein the step of creating a digital association is between the selected security alert and the electronic monitoring security device that was last selected before the operator performed the end processing action.

3. The computer-implemented method of claim 1, further including, for each security system:

receiving operational information for each electronic monitoring security device;

categorizing each electronic monitoring security device into one of a plurality of categories of electronic monitoring security devices; and storing each electronic monitoring security device into one of the plurality of categories of electronic monitoring security devices.

4. The computer-implemented method of claim 3, wherein the list of electronic monitoring security devices displayed to the operator on the security-monitoring platform operator interface includes a plurality of lists, wherein each list in the plurality of lists corresponds to one of the plurality of categories of electronic monitoring security devices.

5. The computer-implemented method of claim 4, wherein the step of creating a digital association between the selected security alert and the selected electronic monitoring security device is performed for each of the plurality of categories of electronic monitoring security devices, thereby creating digital associations between the selected security alert and one of the electronic monitoring security devices for each of the plurality of categories of electronic monitoring security devices.

6. The computer-implemented method of claim 5, further including a step of creating and storing associations between each of the electronic monitoring security devices associated with the selected security alert.

7. The computer-implemented method of claim 1, further including a step of removing any previous associations between the selected security alert and a previously associated electronic monitoring security device that is different from the selected electronic monitoring security device.

8. The computer-implemented method of claim 1, further including, for each security system, the steps of:

retrieving a list of possible security alerts producible by each electronic monitoring security device; and identifying each security alert in the list of possible security alerts and storing each identified security alert in the data store.

9. The computer-implemented method of claim 1, wherein a step of automatically initiating an association protocol is in response to the operator selecting the security alert from the security alert list presented to the operator on the security-monitoring platform operator interface.

10. The computer-implemented method of claim 1, wherein the security-monitoring platform operator interface may display several electronic monitoring security devices simultaneously and the step of creating a digital association includes creating a digital association between the selected security alert and each of the selected electronic monitoring security device displayed on the security-monitoring platform operator interface when the end processing action is performed.

11. A computer-implemented method for automatically associating electronic monitoring security devices with a security alert comprising executing on a processor the steps of:

encapsulating an application programming interface for one or more security systems intended to operate in conjunction with a security-monitoring platform;

storing access information for the one or more security systems in a data store that is electronically linked to the security-monitoring platform;

retrieving a list of possible security alerts producible by each electronic monitoring security device;

identifying each security alert in the list of possible security alerts and storing each identified security alert in the data store;

automatically initiating an association protocol in response to a user selecting a security alert from a security alert list presented to an operator on the security-monitoring platform operator interface, wherein the association protocol includes the steps of:

identifying the security alert selected by the operator from the security alert list;

accessing the data store to determine whether any electronic monitoring security devices are digitally associated with the selected security alert;

responsive to identifying a digital association between the selected security alert and any of the electronic monitoring security devices, automatically presenting the associated electronic monitoring security device to the operator on the security-monitoring platform operator interface;

displaying a list of electronic monitoring security devices to the operator on the security-monitoring platform operator interface;

monitoring the list of electronic monitoring security devices to determine whether the operator selects one of the electronic monitoring security devices from the list of electronic monitoring security devices;

for each selection of one of the electronic monitoring security devices from the list of electronic monitoring security devices, displaying the selected electronic monitoring security device to the operator on the security-monitoring platform operator interface; and responsive to the operator completing a processing of the selected security alert, creating a digital association between the selected security alert and the selected electronic monitoring security device.

12. A computer-implemented method for automatically associating security cameras with a security alert comprising executing on a processor the steps of:

encapsulating an application programming interface for one or more security systems intended to operate in conjunction with a security-monitoring platform;

storing access information for the one or more security systems in a data store that is electronically linked to the security-monitoring platform;

retrieving a list of possible security alerts producible by each electronic monitoring security device;

identifying each security alert in the list of possible security alerts and storing each identified security alert in the data store;

automatically initiating an association protocol in response to a user selecting a security alert from a security alert list presented to an operator on a security-monitoring platform operator interface, wherein the association protocol includes the steps of:

identifying the security alert selected by the operator from the security alert list;

accessing the data store to determine whether any security cameras are digitally associated with a selected security alert;

responsive to identifying a digital association between the selected security alert and any of the security cameras, automatically presenting a associated security camera to the operator on the security-monitoring platform operator interface;

displaying a list of security cameras to the operator on the security-monitoring platform operator interface;

monitoring the list of security cameras to determine whether the operator selects one of the security cameras from the list of security cameras;

for each selection of one of the security cameras from the list of security cameras, displaying the selected security camera to the operator on the security-monitoring platform operator interface; and responsive to the operator completing a processing of the selected security alert, creating a digital association between the selected security alert and the selected security camera.

* * * * *